US005774033A

United States Patent [19]

Antonelli

[11] Patent Number: 5,774,033

[45] Date of Patent: Jun. 30, 1998

[54] SOLENOID APPARATUS HAVING A PLUNGER WITH AN INTERNAL PASSAGE AND A VACUUM SOURCE FOR GENERATING NEGATIVE PRESSURE

[75] Inventor: Nicholas Antonelli, Harrison, N.Y.

[73] Assignee: Pitney Bowes Inc., Stamford, Conn.

[21] Appl. No.: 705,506

[22] Filed: Aug. 29, 1996

Related U.S. Application Data

[62] Division of Ser. No. 498,007, Jul. 3, 1995, Pat. No. 5,581, 972.

[51] Int. Cl.[6] ..... H01F 1/00

[52] U.S. Cl. ..... 335/219; 335/239; 335/240; 335/255; 335/260; 335/261

[58] Field of Search ..... 335/219, 239, 335/240, 255, 260, 261; 251/129.22; 414/627

[56] References Cited

U.S. PATENT DOCUMENTS

| | | | |
|---|---|---|---|
| 747,853 | 12/1903 | Cheyney | 335/240 |
| 1,341,629 | 6/1920 | Brown | 335/239 |
| 2,698,404 | 12/1954 | Edwards | 335/219 |
| 2,757,321 | 7/1956 | Wallace et al. | 335/239 |
| 2,886,720 | 5/1959 | Buck | 335/260 |
| 4,087,773 | 5/1978 | Jencks et al. | 335/243 |
| 5,389,910 | 2/1995 | Abel | 335/238 |
| 5,402,093 | 3/1995 | Gibas et al. | 335/261 |

*Primary Examiner*—Michael L. Gellner
*Assistant Examiner*—Raymond Barrera
*Attorney, Agent, or Firm*—Angelo N. Chaclas; Melvin J. Scolnick

[57] ABSTRACT

Solenoid apparatus having a substantially cylindrical casing, an electro-magnetic coil, a plunger axially aligned and slideably mounted to the casing, a housing hermetically mounted to an end of the casing and a vacuum source operatively coupled to the external port. The plunger has a first end extending outside of the casing, a second end and an internal passage extending from the first end to the second end. The electro-magnetic coil is selectively energizeable for moving the plunger between a first position and a second position. The housing corresponds to the plunger second end to define an inner chamber which encloses the plunger second end. The housing includes an external port connected to the inner chamber so as to provide an unobstructed pathway from the external port to the first end of the plunger via the internal passage and the inner chamber regardless of whether the plunger is in the first position, the second position or therebetween. The vacuum source is selectively activatable for generating negative pressure at the first end of the plunger via the inner chamber and the internal passage.

4 Claims, 9 Drawing Sheets

SOLENOID APPARATUS HAVING A PLUNGER WITH AN INTERNAL PASSAGE AND A VACUUM SOURCE FOR GENERATING NEGATIVE PRESSURE

CROSS REFERENCE TO RELATED APPLICATION

This application is an Divisional of U.S. patent application Ser. No. 08/498,007 filed on Jul. 3, 1995 and issued as U.S. Pat. No. 5,581,972.

FIELD OF THE INVENTION

This invention relates to container opening apparatus, and more particularly, to an apparatus for opening an envelope.

BACKGROUND OF THE INVENTION

A variety of containers exist that are individually suited to packaging, holding, shipping and storing a great many different types of contents. For example, an envelope is a special type of container used to store and ship enclosures (business letters, invoices, photographs, advertisements, etc.). Another example is a paper carton that is used to store a given number of packages of cigarettes. Still other examples are video and audio tape boxes which are used to store and ship tapes. Thus, it is apparent that there is a great diversity in the types, shapes and sizes of containers. Typically, the containers are made from a plurality of panels which are arranged to encompass a desired volume of space having a desired configuration. To gain access to the inside of the container it is necessary for at least one panel to be moveable with respect to the remaining panels. This is usually accomplished by a hinge arrangement where the moveable panel is connected to an adjacent panel along one edge. However, other arrangements are commonly used depending upon the application.

Often times, in placing contents into containers or in taking contents out of containers, there is a need for automatic equipment. Typically, cigarette manufacturers, tape manufacturers and high volume mailers utilize a great deal of automation to reduce costs and speed production. Necessarily then, the container must be opened before any later tasks can be performed. As a result of this need, a great many different types of container opening systems have been developed. Outlined below is a description of some of the container opening systems that are known in the art. Although most of the systems are from the envelope opening art, the concepts and underlying technology are similar and adaptable to those found in other disciplines using different containers.

Envelope handling machines are well known in the art. Typical types of envelope handling machines include: mailing machines, inserters, sorters and incoming mail handling machines. Frequently, these machines have the need to open an envelope so that a desired task or operation can be performed. For example, in an inserter it is necessary to open the envelope so that an enclosure can be fed into the envelope. Another example is in incoming mail handling machines where it is necessary to open the envelope so that the enclosures (possibly placed into the envelope by an inserter) can be removed from the envelope.

Many different systems exist to open envelopes and containers. Early systems were mechanical in nature and relied upon arms or fingers to reach inside the envelope in order to open it. Examples of such systems are shown in U.S. Pat. Nos. 4,337,609, 5,255,498, 5,191,751, and 5,247,780 all of which are assigned to the assignee of the present invention. Although many improvements have been made over the years and such systems are generally effective, they still suffer from certain drawbacks. First, the envelopes are susceptible to damage by the moving parts of the system. Despite efforts to the contrary, inevitably envelopes are still torn or crushed by such systems. Second, because such mechanical systems are sensitive to wear, they need frequent recalibration and/or preventive maintenance.

Still other systems use a combination of vacuum and mechanical technologies to open envelopes and other containers. Examples of such systems are shown in U.S. Pat. Nos. 4,486,013, 4,776,152, and 5,052,168. In these systems, moveable sucker feet are brought into and out of engagement with the container by means of any suitable mechanical device. Additionally, the sucker feet are directly connected by tubes to a vacuum source in order to create the vacuum necessary to grab the envelope. Although these systems have less physical contact with the envelope than the pure mechanical systems, they too suffer from drawbacks. First, because the vacuum tubes are carried along with the sucker feet, they are in constant motion. In high throughput operations where the container opening apparatus performs many thousands of cycles per hour, there is a risk that the vacuum tube will shake itself loose from the sucker foot. Second, the vacuum tube is susceptible to wear as it rubs up against adjacent components cycle after cycle. In an extreme case, the vacuum tube may even become tangled. All of these problems result in a loss of vacuum at the sucker foot where it is needed and require operator intervention to correct.

Accordingly, there is a need for a container opening apparatus that provides reliable operation without the risk of damage to the container, risk of loss of vacuum or frequent maintenance.

SUMMARY OF THE INVENTION

The present invention contemplates an apparatus for opening a container including at least one moveable panel. The apparatus comprising a frame, vacuum source means, means for gripping the container and a solenoid fixably mounted to the frame. The solenoid including a moveable plunger having a first end and an internal passage having an opening at the first end and being in communication with the vacuum source means. The gripping means mounted to the plunger first end. Also, the apparatus additionally including control means for actuating the plunger between a home position where the gripping means is spaced apart from the moveable panel and an operative position where the gripping means contacts the moveable panel. The vacuum source means for applying negative pressure to the internal passage so that the moveable panel adheres to the gripping means as the plunger moves from the operative position to the home position separating the moveable panel from the container and opening the container.

Therefore, it is now apparent that the invention achieves all the above objects and advantages. Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

DETAILED DESCRIPTION OF THE PREFERRED EMBODIMENT

Figure 1:
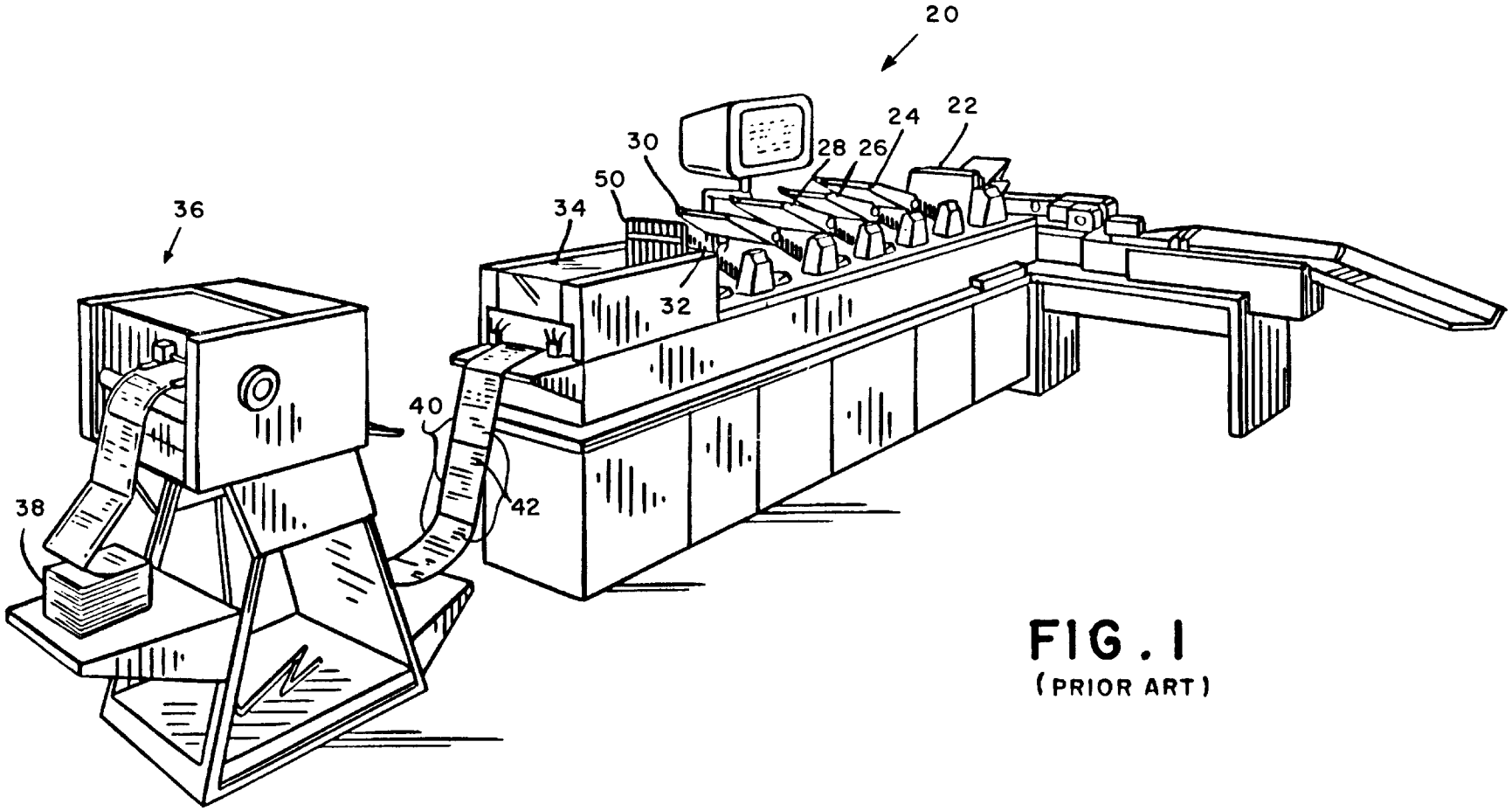
FIG. 1 (PRIOR ART)
FIG. 1 is a perspective view of a prior art console inserter in which the present invention may be employed.

In describing the preferred embodiment of the present invention, reference is made to FIG. 1 wherein a prior art console inserter 20 in which the present invention may be employed is shown. Although the description to follow is provided with respect to a container opening apparatus used to open envelopes in the inserter 20, those skilled in the art will recognize other applications for the same apparatus.

The console inserter 20 includes a plurality of serially arranged modules including envelope feeder/insert station 22 and enclosure feeder stations 24, 26, 28, 30 and 32 and burster/folder station 34. A web form feeder 36 feeds a computer generated continuous web 38 of control documents 40 having coded markings 42 thereon. The burster/folder 34 separates the web 38 into individual documents 40 and then folds the documents 40. Additionally, as the documents 40 are fed through the burster/folder 34, the control markings 42 are sensed by control scanner 50. Thereafter, the documents 40 are fed downstream where feeder stations 24, 26, 28, 30 and 32 selectively and sequentially feed the necessary enclosures to the transport path according to the instructions contained within the control markings 42 of each document 40. Thus, a collated stack consisting of the document 40 and respective enclosures is delivered to the station 22 where the stack is inserted into an envelope. Then, the envelope is fed downstream where other additional operations are performed. A detailed description of the inserter 20 is found in U.S. Pat. No. 4,547,856, incorporated herein by reference.

Figure 2:
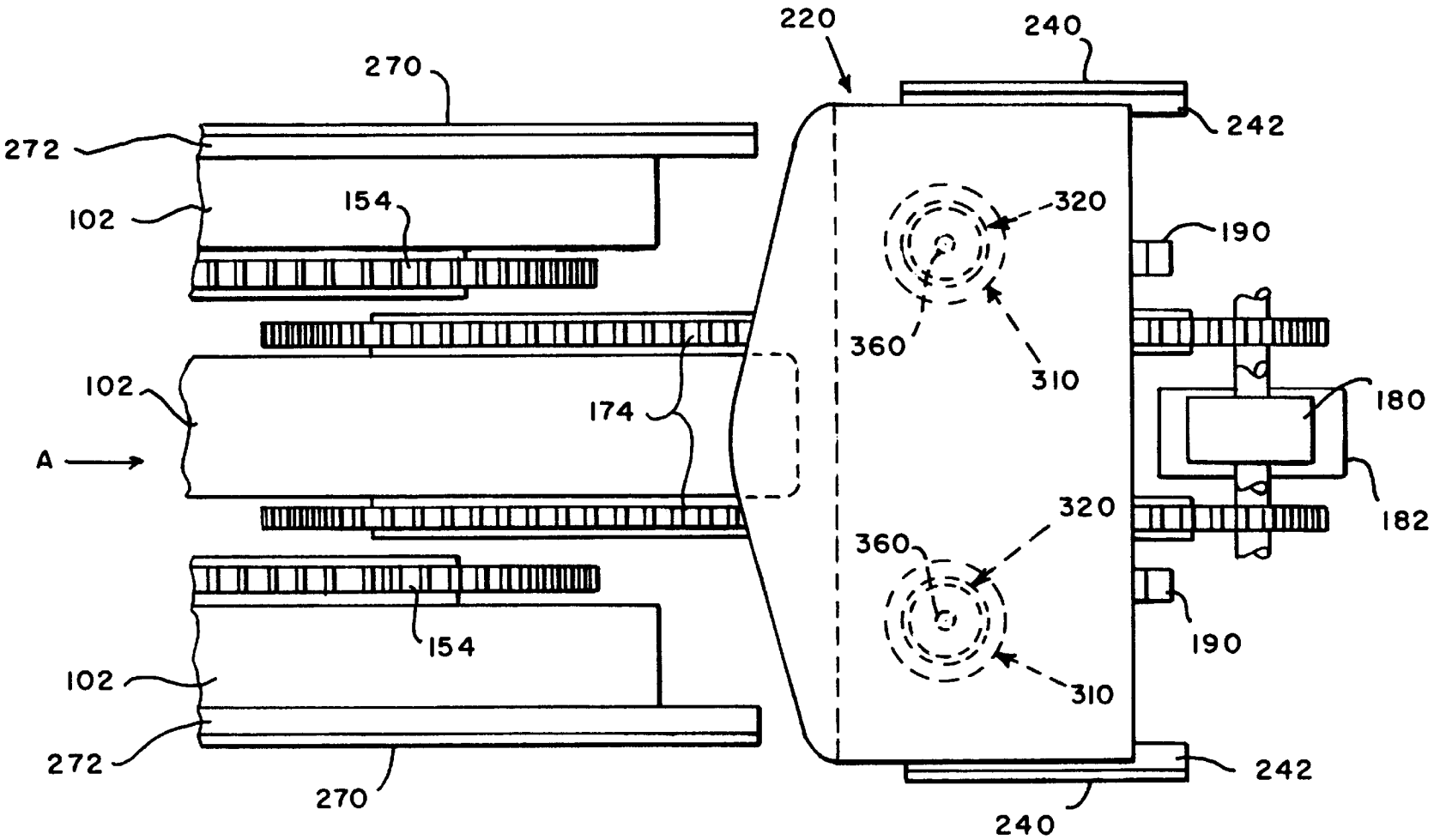
FIG. 2 is a top plan view of a container opening apparatus in accordance with the present invention.
Figure 3A:
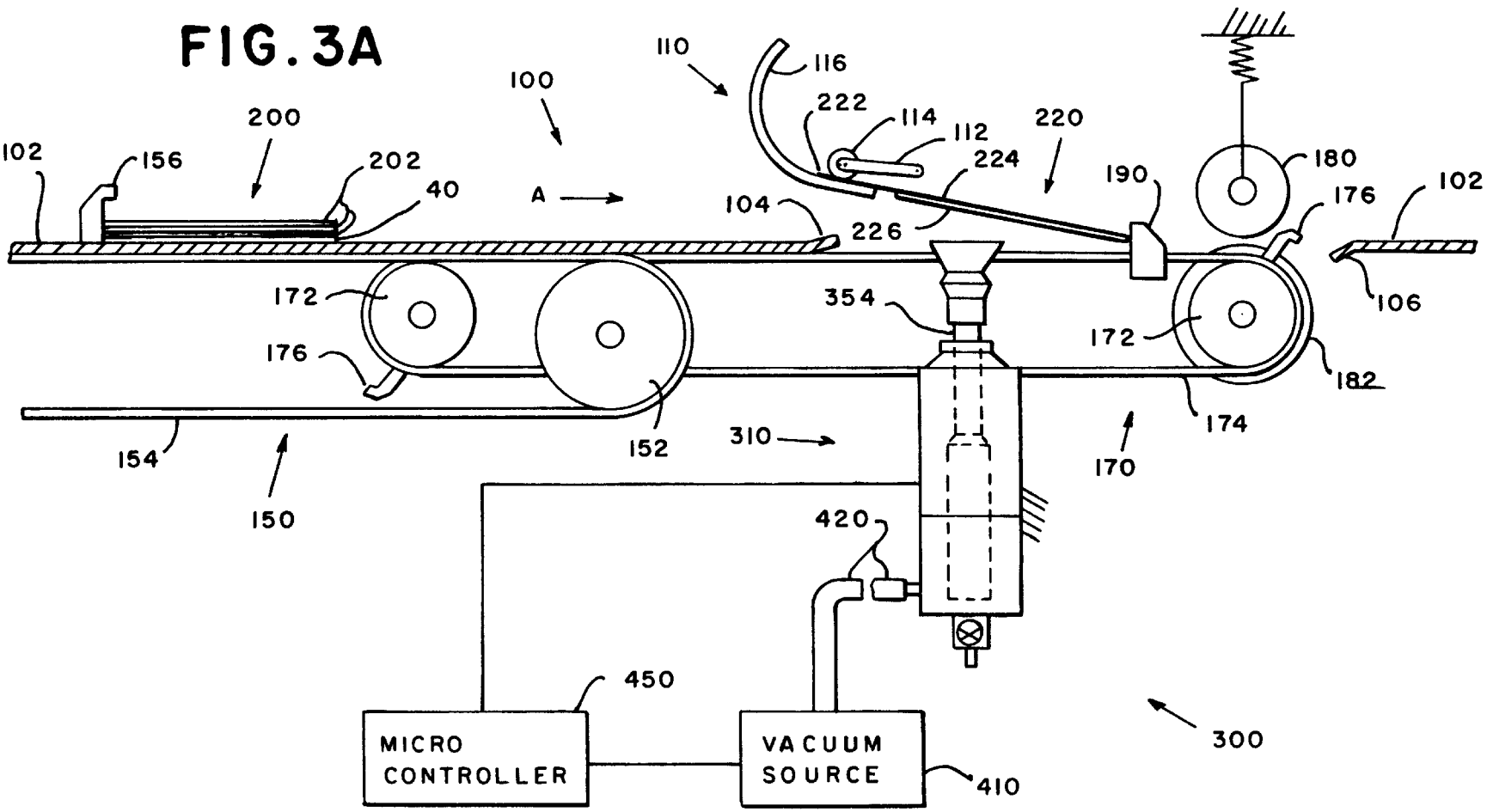
FIGS. 3A through 3E are side elevational views of the apparatus representing different stages in one cycle of the operation of the apparatus.

Referring to FIGS. 2 and 3A, an insert station 100 is shown which includes an envelope feeder 110, envelope stuffing apparatus and envelope opening apparatus 300. The feeder 110 is only partially shown. The insert station 100 includes suitable framework, not shown, for mounting and supporting the various components of the feeder 110, stuffing apparatus and opening apparatus 300.

A stack 200, including the folded control document 40 and a plurality of enclosures 202 supplied by the feeder stations 24, 26, 28, 30 and 32, is fed along a deck 102 in a downstream path of travel as indicated by arrow A through the insert station 100. To feed the stack 200 along the deck 102 and into an empty envelope 220 pusher assemblies 150 and 170 operate successively on the stack 200. Each pusher assembly 150 and 170 includes a respective pair of sub-assemblies that are laterally aligned so as to act in parallel and in cooperation to feed the stack 200. For each pusher assembly 150 and 170, a description is provided with respect to one of the pairs of sub-assemblies since the other is substantially identical.

The pusher assembly 150 is located at the input end of insert station 100 and adjacent to the output end of the enclosure feeder 24. The pusher assembly 150 includes a pair of pushers 156 attached to an endless chain 154 which is mounted on a pair of sprockets 152 (only one is shown). As the sprockets 152 rotate causing the chain 154 to advance, the pushers 156 alternatively rise above and fall below the deck 102 which contains suitable openings so as not to interfere with the pushers 156. The pushers 156 feed the stack 200 at a known speed dependent on the upon the rotational speed on the sprockets 152 which are under the control of a drive mechanism (not shown).

The pusher assembly 170 is located downstream from the pusher assembly 150. The pusher assembly 170 includes a pair of pushers 176 attached to an endless chain 174 which is mounted on a pair of sprockets 172. As the sprockets 172 rotate causing the chain 174 to advance, the pushers 176 alternatively rise above and fall below the deck 102 which contains suitable openings so as not to interfere with the pushers 176. The pushers 176 feed the stack 200 at a known speed which is approximately one and a half (1.5) times the speed of pusher 156.

The pusher assemblies 150 and 170 overlap so that in operation the stack 200 can be transferred from assembly 150 to assembly 170. It should now be understood that the spacing of the pushers 156 and 176 along chains 154 and 174, respectively, is coordinated so that pushers 176 overtake pushers 156 shortly after pushers 156 deliver the stack 200 into the overlap area. Thus, the stack 200 has been taken away from the pushers 156 by the faster pushers 176 before the pushers 156 pass beneath the deck 102 and reposition for another cycle. It should also be understood, that any other suitable mechanism, a belt for example, could be used to drive the pushers 156 and 176.

Envelopes 220 are fed from the envelope feeder 110 to an insert position where the stack 200 is inserted into the envelope 220. In the preferred embodiment of the present invention, the envelope 220 rests in the insert position on a pair of adjustable guides 240 which may be repositioned in a direction transverse to the path of travel A so that different size envelopes 220 may be accommodated. The guides 240 each include a shelf portion 242 for supporting the edges of the envelope 220. The shelf portions 242 are at a slight angle from horizontal so as to deliver the envelope 220 into the path of travel. An example of an envelope feeder 110 which can be used in conjunction with the present invention is described in U.S. Pat. No. 4,775,140 which is incorporated herein by reference.

A pair of stops 190 rise above and fall below the deck 102 and shelf portion 242 as necessary to stop and register the envelope 220 in the insert position. Any one of numerous mechanisms would be suitable for raising and lowering the stops 190. While seated against the stops 190 and resting on the shelf portions 242, the envelope flap 222 which is in an open position is supported by ledge 116. A plurality of depressor fingers 112, each including a roller 114, apply pressure to the envelope flap 222 holding it against the ledge 116. Additionally, the depressor fingers 112 provide stability to the envelope 220 during opening and insertion of the stack 200 (described below). In the alternative, a pressure plate or other suitable apparatus may be employed to hold down the flap 222.

Referring to FIGS. 2, 3A, 4A and 4B, with the envelope 220 in the insert position, it is necessary to open the envelope 220 prior to insertion of the stack 200. The envelope body includes a front panel 224 and a back panel 226. Generally, the front panel 224 is where the destination address and postal information appear. The envelope flap 222 is typically connected to the front panel 224 along the top edge of the envelope 220. Positioned adjacent to the back panel 226 of the envelope 220 is an opening assembly 300 for separating the back panel 226 from the front panel 224. The opening assembly 300 includes a pair of solenoid assemblies 310, a vacuum source 410 and a hose 420 for connecting the solenoid assemblies 310 to the vacuum source 410. The solenoid assemblies 310 and vacuum source 410 are is communication with a suitably designed microcontroller 450 which provides appropriate signals for energizing the solenoid assemblies 310 and activating the vacuum source 410, respectively.

Figure 4A:
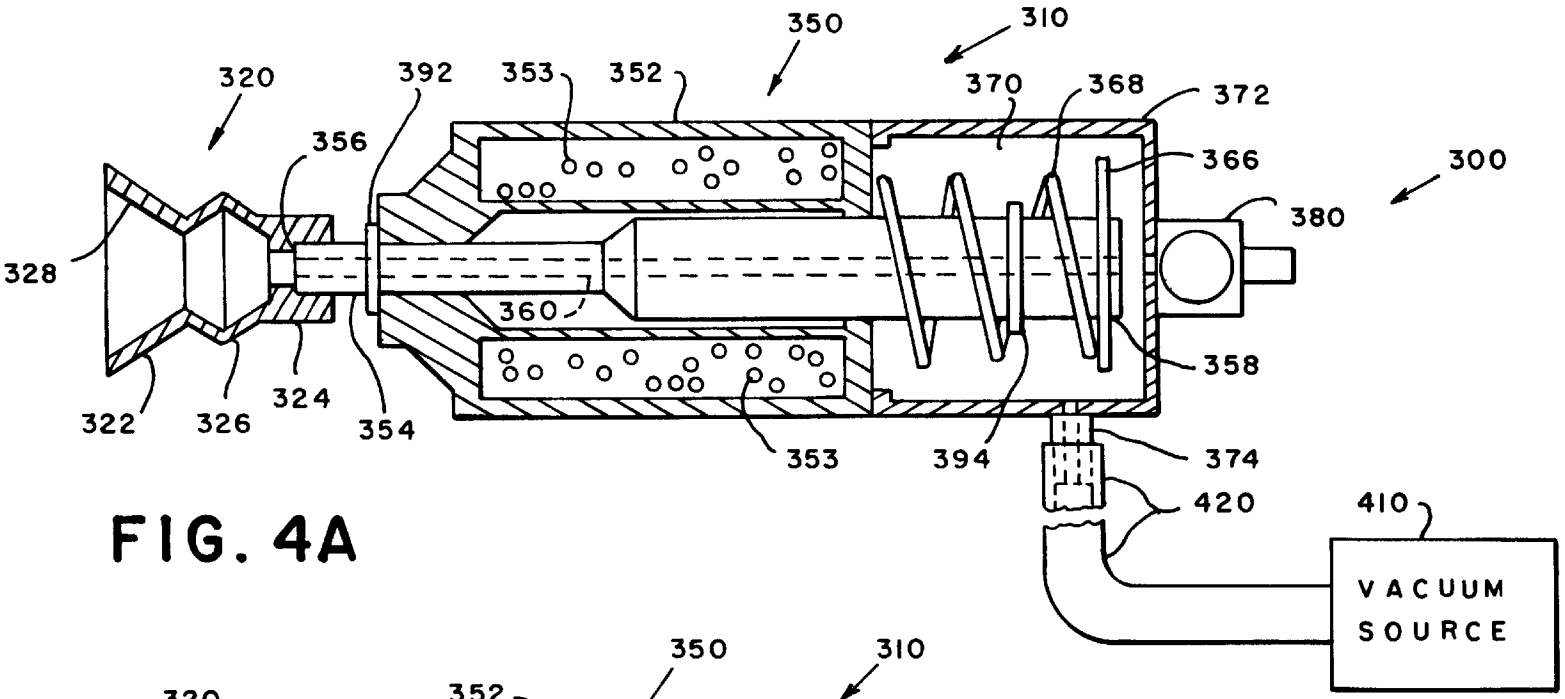
FIG. 4A is a partial sectional and partial break-away view of a modified push type linear solenoid as employed in the apparatus in a de-energized state.
Figure 4B:
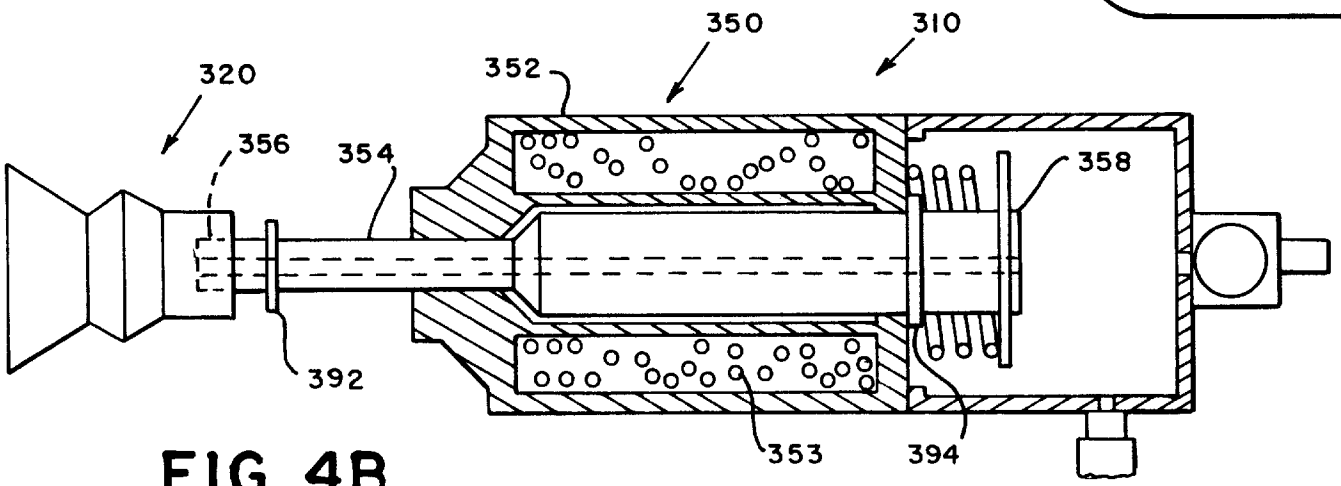
FIG. 4B is a partial sectional and partial break-away view of a modified push type linear solenoid as employed in the apparatus in an energized state.

Referring to FIGS. 4A and 4B, each solenoid assembly 310 includes a sucker foot 320 and a linear solenoid 350. It is important that the sucker foot 320 is made from a suitably flexible material with a high coefficient of friction. The linear solenoid 350 includes a generally cylindrical casing or housing 352, a plunger 354 slideably mounted to the housing 352 and a wire coil 353 for inducing a magnetic force on the plunger 354 causing it to move between an extended and a retracted position. The plunger 354 is generally rod shaped and has a first end 356 with which some task is to be performed and a second end 358. Running the length of the plunger 354 from the first end 356 to the second end 358 is a hole 360. The sucker foot 320 includes a suction end 322, a flange end 324, a flexible portion 326 disposed between the suction end 322 and the flange end 324 and an opening 328 running from the suction end 322 to the flange end 324. The sucker foot 320 is attached to the plunger 354 by slipping the flange end 324 over the first end 356.

The solenoid 350 is a push type solenoid; meaning that it operates in only one direction. FIG. 4A shows the plunger 354 in a retracted position in a de-energized state. This position is also referred to as a home position. When the coil 353 is energized, as shown in FIG. 4B, the resulting magnetic force on the plunger 354 causes the plunger first end 356 to extend or move away from the plunger housing 352 to an extended or operative position. Since the solenoid 350 is oriented vertically with the first end 356 pointing up, gravity will return the plunger 354 to the retracted position once the coil 353 is de-energized. In some slow speed and low friction operations, a gravity return may be sufficient. However, in a high speed operation with the added complications of increased friction due to paper dust and other contaminants as in the present invention, a quicker more dependable return mechanism is needed.

Therefore, to overcome friction and any residual magnetism a spring assembly is used to return the plunger 354 to the home position once the solenoid 350 has been deactivated. Thus, each solenoid assembly 310 includes a clip 366 mounted to the plunger 354, preferably at the second end 358, and a compression spring 368 axially positioned along the plunger 354 to extend between the clip 366 and the housing 352. The spring 368 should be assembled so that it has a slight pre-load, compression, in the retracted position. The clip 366 and spring 368 arrangement serve to bias the plunger 354 in the home position. Thus, energizing and de-energizing the coil 353 controls the position of the plunger 354 by providing sufficient magnetic force on the plunger 354 to overcome the spring bias.

For limiting the stroke of the plunger 354, each solenoid assembly 310 includes a pair of stops 392 and 394. Stop 392 is mounted near the plunger first end 356. As shown in FIG. 4A, the stop 392 rests against the housing 352 to prevent further travel of the plunger 354 due to the spring bias. As shown in FIGS. 4B, the stop 394 is mounted near the plunger second end 358 and rests against the housing 352 to prevent further travel of the plunger 354 due to the magnetic force induced by the solenoid 350.

Also included in each solenoid assembly 310 is a generally hollow housing 372 which is hermetically mounted to the solenoid housing 352 adjacent to the second end 358 of the plunger 354. Thus, the housing 372 creates a chamber 370 within which the second end 358 of the plunger 354 moves. The housing 372 includes a port 374 which serves as an inlet to chamber 370 and is connected to the vacuum source 410 via hose 420. Therefore, it should now be apparent that when the vacuum source 410 is activated, the air in the chamber 370 is evacuated and the resulting negative air pressure is translated along the plunger hole 360 and through the sucker foot 320. Thus, the hole 360 functions as an internal passage to the plunger 354 to carry the negative pressure from the chamber 370 to the sucker foot 320. Additionally, mounted to the housing 372 is an air flow control valve 380 which is adjustable to allow a small amount of air to leak into the chamber 370 while the vacuum source 410 is activated. Thus, valve 380 provides a connection from the inner chamber 370 to the outside environment. Valve 380 is of a type commonly available from numerous suppliers, such as Versa Products Company, Inc. of Paramus, N.J. It is important that the vacuum source 410 when activated is sufficiently powerful to create negative pressure regardless of the air leaking into the chamber 370 from the valve 380. The benefits of this arrangement will be discussed below.

In a more simplified embodiment, the solenoid assembly 310 is reconfigured so that the sucker foot 320 does not have a flexible portion but merely a suction end and a flange end. Also, it is possible to fit the hose 420 directly onto the plunger second end 358 and thus eliminate the housing 372, chamber 370, port 374 and valve 380.

Figure 5A:
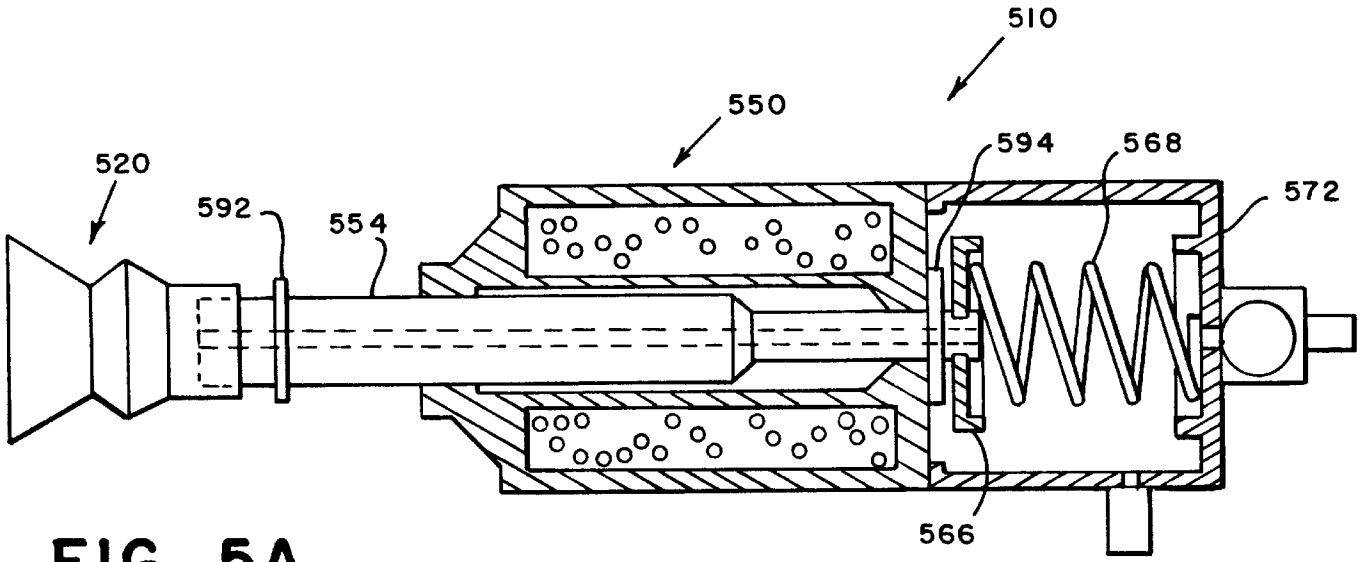
FIG. 5A is a partial sectional and partial break-away view of a modified pull type linear solenoid that could alternatively be employed in the apparatus in a de-energized state.
Figure 5B:
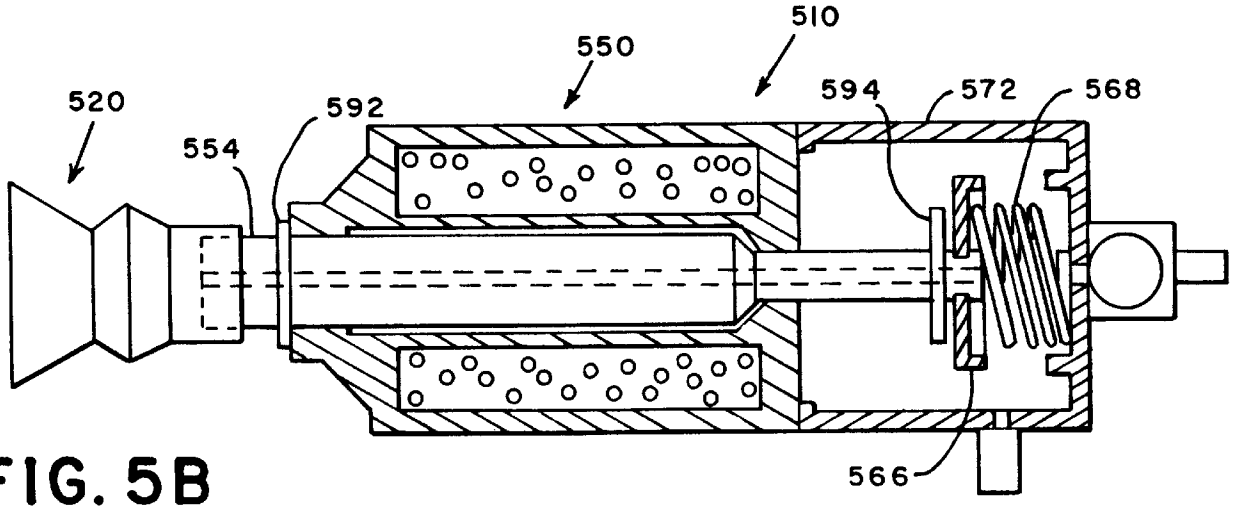
FIG. 5B is a partial sectional and partial break-away view of a modified pull type linear solenoid that could alternatively be employed in the apparatus in an energized state.

In an alternative embodiment, a pull type solenoid could be used. Referring to FIGS. 5A and 5B, a solenoid assembly 510 using a pull type solenoid 550 is shown. As discussed above for the solenoid assembly 310, each solenoid assembly 510 includes a sucker foot 520 and a housing 572. These features remain substantially similar to their respective counterparts discussed above and require additional explanation.

However, since the solenoid 550 is a pull type solenoid some minor modifications need to be made. FIG. 5A shows the plunger 554 in an extended or active position in a de-energized state. Spring 568 has been repositioned to bear against the housing 572 and clip 566 so as to bias the plunger 554 in the active position. Stop 594 prevents further travel of the plunger 554. FIG. 5B shows the plunger 554 in a home or retracted position in an energized state. Thus, the magnetic force on the plunger 554 has overcome the spring bias to compress the spring 568. Stop 592 prevents further travel of the plunger in this condition. The remaining characteristics of assembly 510 are substantially similar to those of assembly 310 are thus require no further discussion beyond that already provided and what is inherent from FIGS. 5A and 5B.

Those skilled in the art will appreciate that the movement of the pushers 156 and 176, feeding of the envelope 220, raising of the stops 190 and activation of the opening assembly 300 are appropriately timed to ensure proper operation. The following description is provided with reference to FIGS. 3A–3E to summarize the operation of one cycle in the insert station 100.

Referring to FIGS. 2 and 3A, the stack 200 is being pusher by the pushers 156 downstream towards the insert area. A pair of adjustable guides 270 having horizontal portions 272 assist in registering the stack 200 prior to insertion and preventing the stack 200 from becoming skewed. The guides 270 may be repositioned in a direction transverse to the path of travel A so that different size stacks 200 may be accommodated. The stack guides 270 are thus positioned slightly inboard from envelope guides 240. Simultaneously, the stops 190 are raised and the envelope 220 is fed from the envelope feeder 110 until it encounters the stops 190. In this position, the envelope 220 is resting against the stops 190 and supported by the shelf portion 242 of guides 240. Additionally, the envelope flap 222 is pressed against the ledge 116 by the rollers 114 because the fingers 112 are in the down position. Thus, the envelope 220 is stationary and stabilized. Additionally, the solenoid plunger 354 is not energized and shown in the home or retracted position.

Figure 3B:
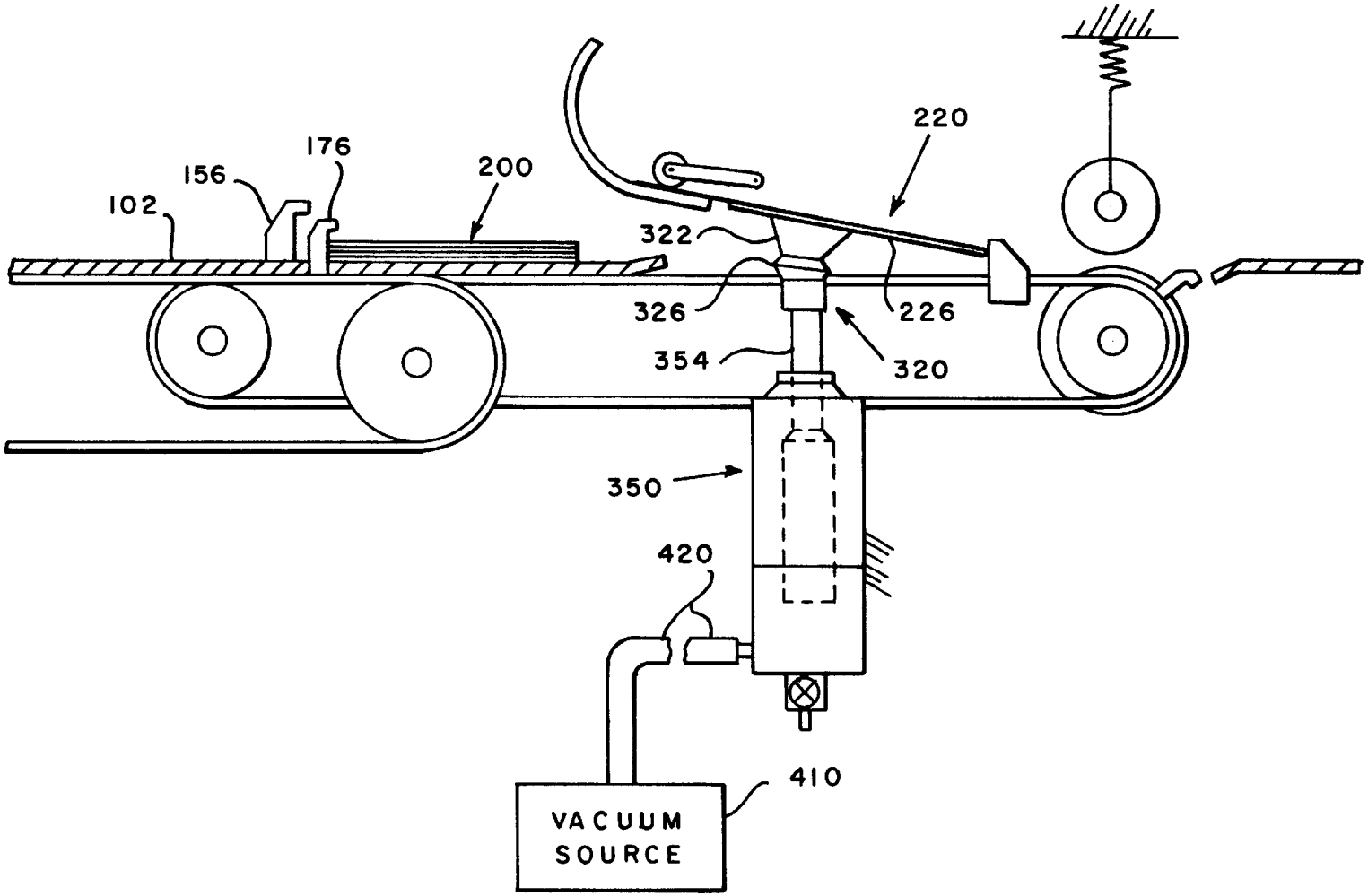

Referring to FIG. 3B, the pushers 176, which are traveling 1.5 times faster than pushers 156, take over delivery of the stack 200 before the pushers 156 recess below the deck 102. Simultaneously, the vacuum source 410, which may be of a conventional vacuum pump design, is activated. It is important that the vacuum source 410 is sufficient to overcome the leakage due to the valve 380. In this way, a negative pressure is created in the chamber 370 and at the sucker foot suction end 322 via the passage 360. Next, the solenoid 350 is energized causing the plunger 354 to move to the extended or operative position where the sucker foot suction end 322 contacts the envelope back panel 226. Because the suction foot 320 is made from a flexible material, such as rubber, it conforms to the shape of the back panel 226. Due to the negative pressure, the back panel 226 is drawn against and adheres to the suction end 322. It is important to note that the distance from suction end 322 in the retracted position to the back panel 226 is selected so that the stroke of the plunger 354 will ensure that the suction end 322 contacts the back panel 226 in the extended position. Additionally, this distance is selected so that the flexible portion 326 of the sucker foot 320 compresses slightly due to the contact with the back panel 226. In this manner, the apparatus is more tolerant of variances in manufacture and envelope thicknesses. Furthermore, the compression of the flexible portion 326 reduces the impact force on the envelope 220.

Figure 3C:
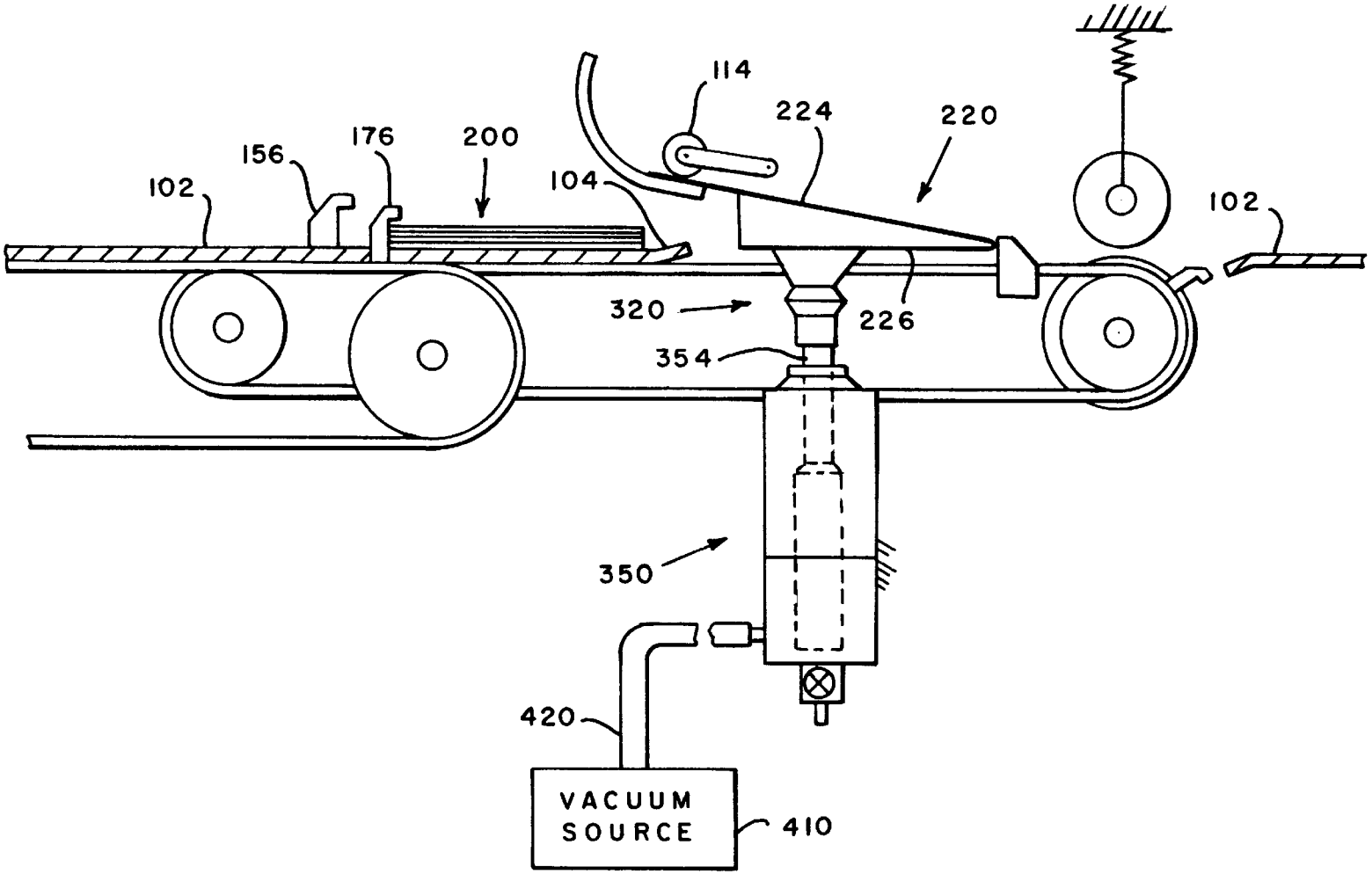

Referring to FIGS. 2 and 3C, the solenoid 350 has been de-energized and the spring 368 returns the plunger 354 to the retracted position. However, the vacuum source 410 remains activated. Because of the negative pressure, flexibility of the sucker foot 320 and the high coefficient of friction, the back panel 226 and the sucker foot 320 remain in intimate contact. Thus, as the plunger 354 and sucker foot 320 retreat, the envelope back panel 226 stays adhered to the suction end 322 and separates from the opposing front panel 224 which is held in a fixed position by the rollers 114 and guide shelf portion 242. The envelope 220 is now ready to accept the stack 200 as the pushers 176 advance. Furthermore, the deck 102 includes a ramp portion 104 to prevent the stack 200 from crashing into the edge of the back panel 226 as the stack 200 is fed into the envelope 220.

Figure 3D:
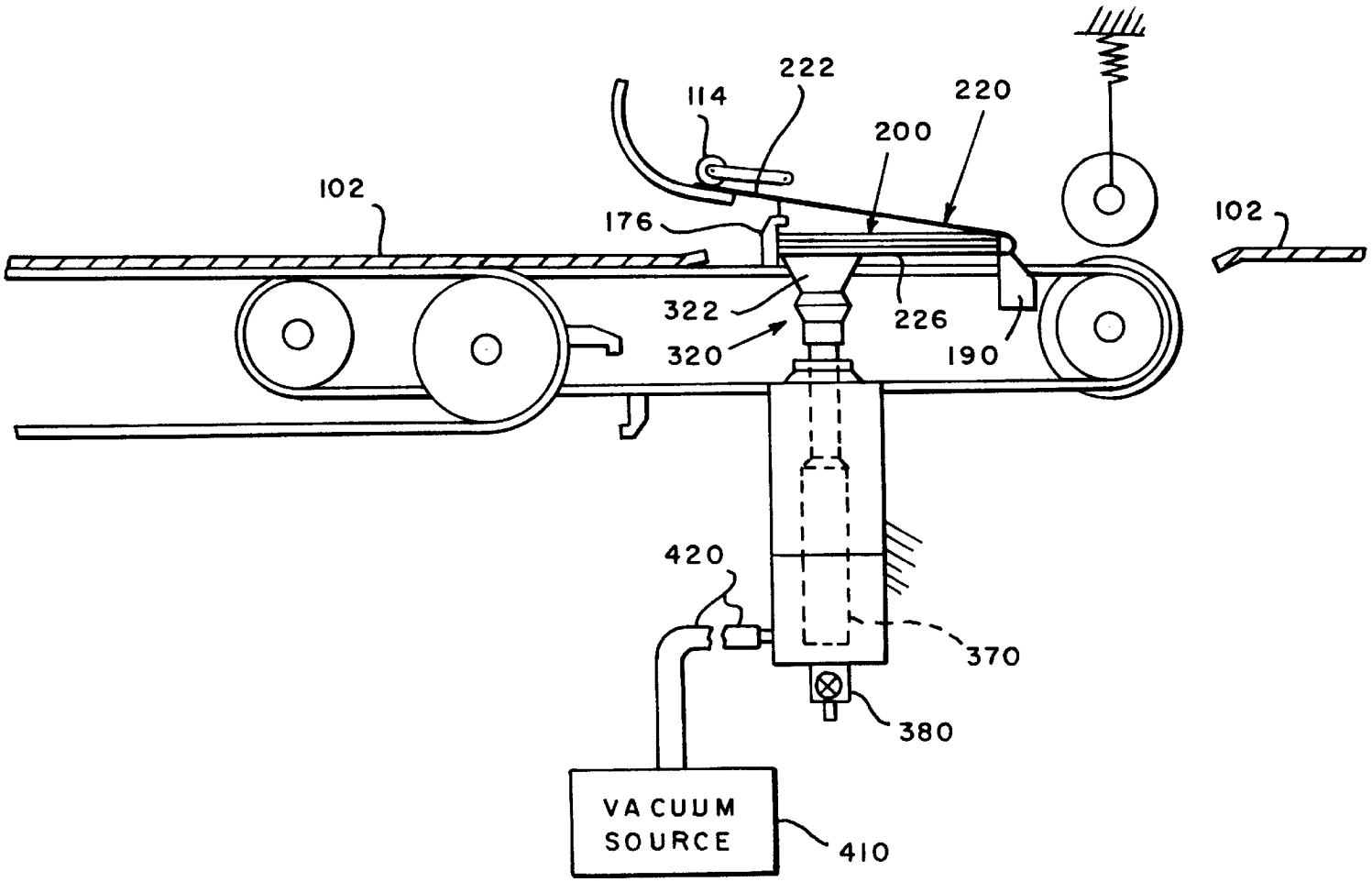

Referring to FIG. 3D, the stops 190 have descended below the deck 102 as the stack 200 is fed completely into the envelope 220. The rollers 114 remain in the down position to provide resistance to the movement of the envelope 220. This ensures that the stack 200 is properly seated in the envelope 220 before the pushers 176 supply enough force to overcome the hold down force of the rollers 114 on the envelope flap 222 so as to feed the envelope 220 downstream. At this point, the vacuum source 410 is de-activated and air leaks into the chamber 370 due to the pressure gradient via the valve 380 so as to dissipate the negative pressure which has been built up. Air leaks into the chamber 370 until the pressure inside the chamber 370 reaches ambient conditions. Thus, the valve 380 ensures that no residual negative pressure remains which would cause the back panel 226 to remain adhered to the sucker foot 320 after the vacuum source 410 has been de-activated. Also, this ensures that the suction end 322 quickly releases the back panel 226 and no skewing or misalignment of the envelope 220 occurs during feeding.

Figure 3E:
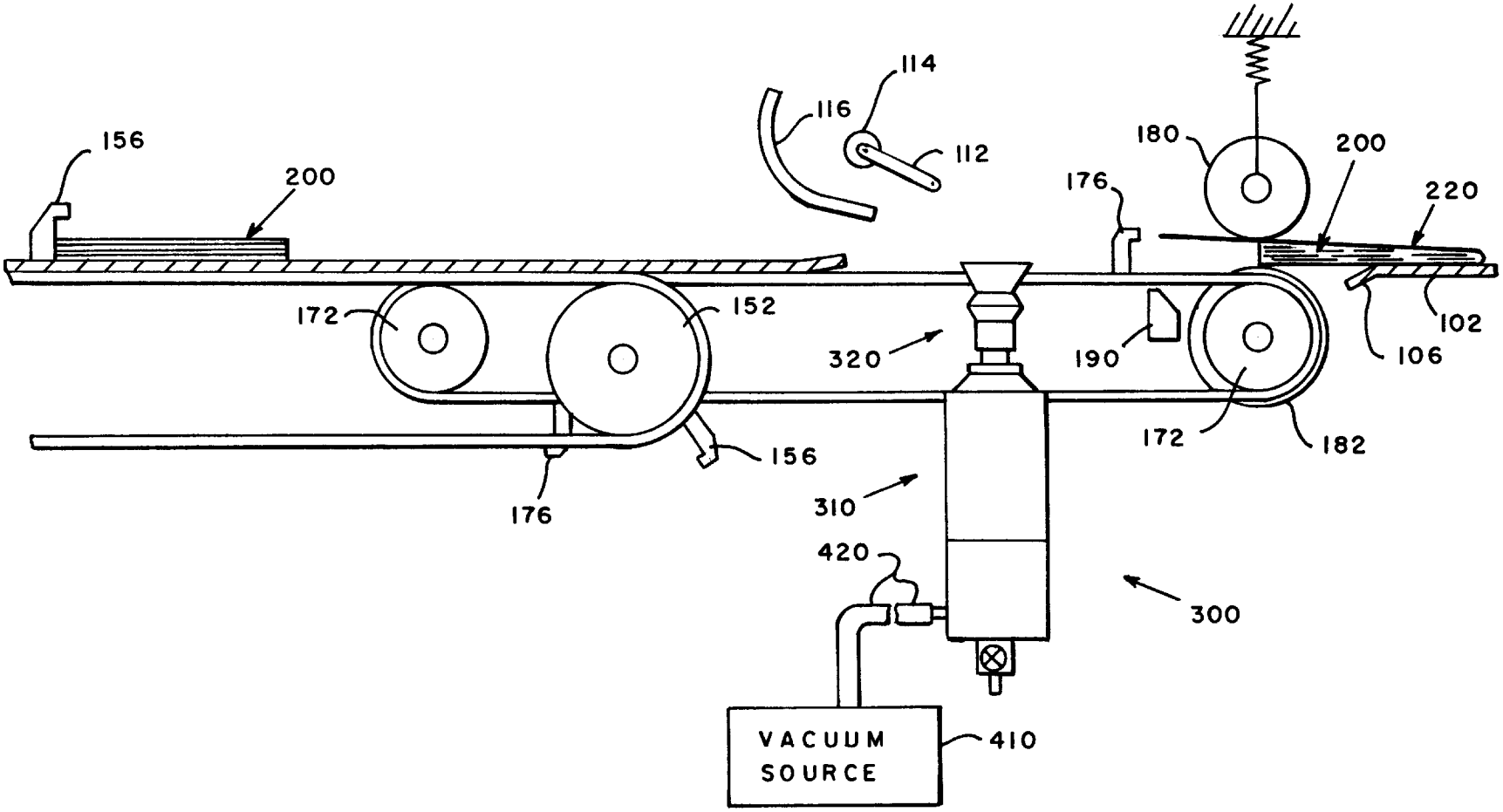

Referring to FIGS. 2 and 3E, the pushers 176 continue to feed the envelope 220, with the stack 200 properly seated inside, downstream toward the take-away rollers 180 and 182. The deck 102 contains a ramp portion 106 to assist feeding the envelope from guide shelf portions 242 back onto the deck 102. The fingers 112 are now shown in an up position where the rollers 114 are spaced apart from the ledge 116. Therefore, no further hold down pressure is provided. Finally, the rollers 180 and 182 feed the envelope 220 downstream before the pushers 176 recess below the deck 102. Once cycle is now complete.

Those skilled in the art will now recognized the advantages of the present invention over the prior art. For example, the hose 420 is located away from the sucker foot 320 and remains stationary during the entire operation of the opening apparatus 100. This reduces wear and the risk of the tube shaking loose from its connections to the vacuum source 410 and the port 374. Also, it keeps the hose 420 away from the path of travel where it could interfere with the envelope 220 or become tangled with other moving parts. Since the only moving parts are the plunger 350 and sucker foot 320, ease of manufacture and reduction in part count are both achieved. All these benefits have the net effect of a more reliable opening apparatus requiring less operator intervention.

Many of the design details of the present invention have alternatives that would be obvious to those skilled in the art. For example, an envelope feeder could be designed to deliver envelopes with the back panel facing up. This might necessitate that the opening apparatus be relocated to a position above the deck. Alternatively, the opening apparatus may be employed against the front panel of the envelope while the back panel of the envelope is retained. Thus, the container need only have one moveable panel for the opening apparatus to act upon.

Additionally, other stack feeding apparatus are well known in the art that could effectively replace the pushers used in the present invention while the exact means used to retain and support the envelope during opening are not particular to practicing the invention. Furthermore, it is possible to substitute a rotary solenoid, linear motor or other electro-magnetically actuated device for the linear solenoid described above. Only small modifications in design detail would be necessary to accomplish this. Those skilled in the art will obviously be capable of deducing still further substitutions.

Moreover, those skilled in the art will find other uses for the solenoid 350. For example, the solenoid 350 may be utilized to deliver: air, water, glue, paint, wax, and so forth to a work area. By connecting the solenoid 350 to an external device, bedsides a vacuum source as described in the preferred embodiment, a wide variety of additional uses become available.

Many features of the preferred embodiment represent design choices selected to best exploit the inventive concept as implemented in an envelope opening apparatus as used in an inserter. Those skilled in the art will recognize that the present invention is appropriate for other applications as discussed above in the "Background of the Invention" with only minor modifications to the preferred embodiment. Accordingly, various modifications may be made without departing from the spirit of the general inventive concept. Therefore, the invention in its broader aspects is not limited to the specific details of the preferred embodiment but is defined by the appended claims and their equivalents.

What is claimed is:

1. A solenoid apparatus comprising:

a substantially cylindrical casing, a plunger axially aligned and slideably mounted to said causing, said plunger having first end extending outside of said casing, a second end and an internal passage extending from said first end to said second end, electro-magnetic means which is selectively energizeable for moving said plunger between a first position and a second position, a housing hermetically mounted to an end of said casing corresponding to said plunger second end to define an inner chamber which encloses said plunger second end, said housing including an external port connected to said inner chamber so as to provide an unobstructed pathway from said external port to said first end of said plunger via said internal passage and said inner chamber regardless of whether said plunger is in said first position, said second position or therebetween, and vacuum means operatively coupled to said external port and selectively activatable for generating negative pressure at said first end of said plunger.

2. The solenoid apparatus of claim 1 further comprising:

vent means mounted to said housing for allowing ambient air to leak into said inner chamber so as to dissipate said negative pressure generated by said vacuum means when said vacuum means is not activated.

3. The solenoid apparatus of claim 2 wherein:

said vent means includes an adjustable valve for regulating a rate at which said ambient air leaks into said inner chamber.

4. The solenoid apparatus of claim 3 wherein:

when said vacuum means is activated said resulting negative pressure generated within said inner chamber is sufficient to overcome said rate at which said ambient air leaks into said inner chamber so that negative pressure results at said first end of said plunger.

* * * * *